United States Patent [19]

Gross

[11] 4,047,950

[45] Sept. 13, 1977

[54] METHOD FOR DEVELOPING AN ELECTROSTATIC LATENT IMAGE ON AN ELECTROPHOTOGRAPHIC FILM

[75] Inventor: Frank C. Gross, Wilbraham, Mass.

[73] Assignee: A. B. Dick/Scott, Holyoke, Mass.

[21] Appl. No.: 605,392

[22] Filed: Aug. 18, 1975

Related U.S. Application Data

[60] Division of Ser. No. 459,195, April 8, 1974, Pat. No. 3,916,828, which is a continuation-in-part of Ser. No. 349,452, April 9, 1973, Pat. No. 3,972,610.

[51] Int. Cl.[2] ..... B05B 5/02

[52] U.S. Cl. ..... 96/1 SD; 96/1 R; 118/646; 118/647; 118/662; 118/DIG. 23

[58] Field of Search ..... 96/1 LY, 1 SD; 118/637, 118/DIG. 23, 646, 647, 662; 427/15, 17

[56] References Cited

U.S. PATENT DOCUMENTS

| | | | |
|---|---|---|---|
| 2,859,129 | 11/1958 | Hayford | 96/1 SD |
| 2,942,573 | 6/1960 | Crumrine | 96/1 SD |
| 3,149,550 | 9/1964 | Lohse et al. | 118/637 |
| 3,342,164 | 9/1967 | Lewis | 118/637 |
| 3,371,651 | 3/1968 | Johnson et al. | 118/637 |
| 3,392,706 | 7/1968 | Lloyd | 427/15 |
| 3,392,707 | 7/1968 | Marx | 118/637 |
| 3,407,786 | 10/1968 | Beyer et al. | 118/637 |
| 3,517,993 | 6/1970 | Tyler | 118/637 |
| 3,683,852 | 8/1972 | Yamaguchi et al. | 118/637 |

*Primary Examiner*—Edward C. Kimlin

*Attorney, Agent, or Firm*—R. Duke Vickrey; John W. Kane, Jr.

[57] ABSTRACT

Disclosed is a method and apparatus for developing an electrostatic latent image on an electrophotographic film through use of a special developing chamber forming a passageway through which electrostatically charged toner particles are conducted to contact the film. The chamber has an opening bordered by a mask against which the film is placed to form a seal, an inlet through which toner particles and drying air enter the chamber, and an outlet through which toner particles and drying air leave the chamber. The apparatus further includes supply means for providing toner particles to the chamber, toner flow-control means for permitting a predetermined quantity of toner particles to flow through the developing chamber at predetermined times, air supply means for supplying drying air to the inlet of the chamber, and vacuum means connected to the outlet of the chamber for drawing the toner particles and air through the chamber. The vacuum means creates a sub-atmospheric pressure within the chamber to prevent leakage of toner particles from the chamber around the film.

3 Claims, 4 Drawing Figures

METHOD FOR DEVELOPING AN ELECTROSTATIC LATENT IMAGE ON AN ELECTROPHOTOGRAPHIC FILM

RELATED APPLICATIONS

This is a division of application Ser. No. 459,195 filed Apr. 8, 1974, now U.S. Pat. No. 3,916,828, which is a continuation-in-part of U.S. pat. application Ser. No. 349,452, filed Apr. 9, 1973, now U.S. Pat. No. 3,972,610, entitled ELECTROPHOTOGRAPHIC METHOD AND APPARATUS.

BACKGROUND OF THE INVENTION

1. Field Of The Invention

The present invention relates generally to electrophotography and more particularly to improvements in developing an image on an electrophotographic element.

2. Description Of The Prior Art

In electrophotography, it is common to apply a uniform electrostatic charge to the surface of a photoconductive layer. The charge is then selectively dissipated in a pattern by exposing the surface to a light image. The resulting pattern of charges produces an electrostatic latent image on the photoconductive layer, which is rendered visible by applying to it electrostatically charged toner particles which adhere to the surface of the photoconductive layer by electrostatic attraction. A permanent visible image can be obtained by using toner particles which can be heat fused to the photoconductive layer and subjecting them to a heat application step.

In the conventional developing method using liquid developer, which is a liquid carrier for finely divided electrostatic particles such as carbon particles, the image-exposed film is dipped in the liquid developer to produce a visible image corresponding to the latent image thereon. While this method of developing is satisfactory for some types of systems and film, it is not satisfactory for the type of system in which imaging and developing takes place automatically within a single apparatus, such as the microphotographic copying machine described in commonly assigned co-pending application Ser. No. 349,452 now U.S. Pat. No. 3,972,610. In that microphotographic copying machine, data from successive documents is sequentially recorded on individual frames of a multi-frame microfiche. Because it is desirable to image and develop each frame quickly before repeating the process for the next frame, the process for developing the images must be one which can be carried out quickly and conveniently to a microfiche fixed within a holder within the reproduction apparatus. Additionally, the developing system must be capable of quickly applying the correct amount of developer, or toner particles (which are preferably suspended in a liquid carrier), to the imaged area of the film and removing the toner particles from the film without permitting leakage of the toner particles into the interior of the reproduction apparatus. The system must also be capable of quickly evaporating any of the toner carrier liquid remaining on the film to immobilize the toner particles remaining on the film and prevent smearing of the toned imaged.

Therefore, it is an object of the invention to provide a method and apparatus for quickly applying a measured quantity of liquid toner to an imaged area of a film without permitting leakage of the liquid toner beyond the imaged area of the film. A further object of the invention is to quickly evaporate residual toner carrier liquid remaining on the film after toning. And a further object of the invention is to provide a method and apparatus for accomplishing the above objects while the film is held in a carrier within a microphotographic reproduction apparatus.

SUMMARY OF THE INVENTION

These and other objects are accomplished by the method and apparatus of the invention, which includes a developing chamber forming a passageway through which electrostatically charged toner particles are conducted to the imaged area of an electrostatically charged film. The passageway has an opening bordered by a mask against which the film is placed, and the developing chamber further includes an inlet through which toner particles and drying air enter the chamber and an outlet through which toner particles and drying air leave the chamber. The apparatus of the invention further includes supply means for providing toner particles to the chamber, toner flow control means for permitting a predetermined quantity of toner particles to flow through the developing chamber at predetermined times, air supply means for supplying drying air to the inlet of the chamber, and vacuum means connected to the outlet of the chamber for drawing the toner particles and air through the chamber. The vacuum means creates a sub-atmospheric pressure within the chamber to prevent leakage of toner particles from the chamber around the film.

In its preferred form, the invention includes control means operably connected to the vacuum means for providing a high vacuum level and a low vacuum level, the low vacuum level being used to draw the toner particles through the developing chamber, and the high vacuum level being used to draw the drying air through the chamber. The preferred form of the apparatus further includes a development electrode forming one wall of the passageway for conducting the toner particles through the developing chamber in a position close to the opening through which the toner particles contacts the film.

DESCRIPTION OF THE PREFERRED EMBODIMENTS

Figure 1:
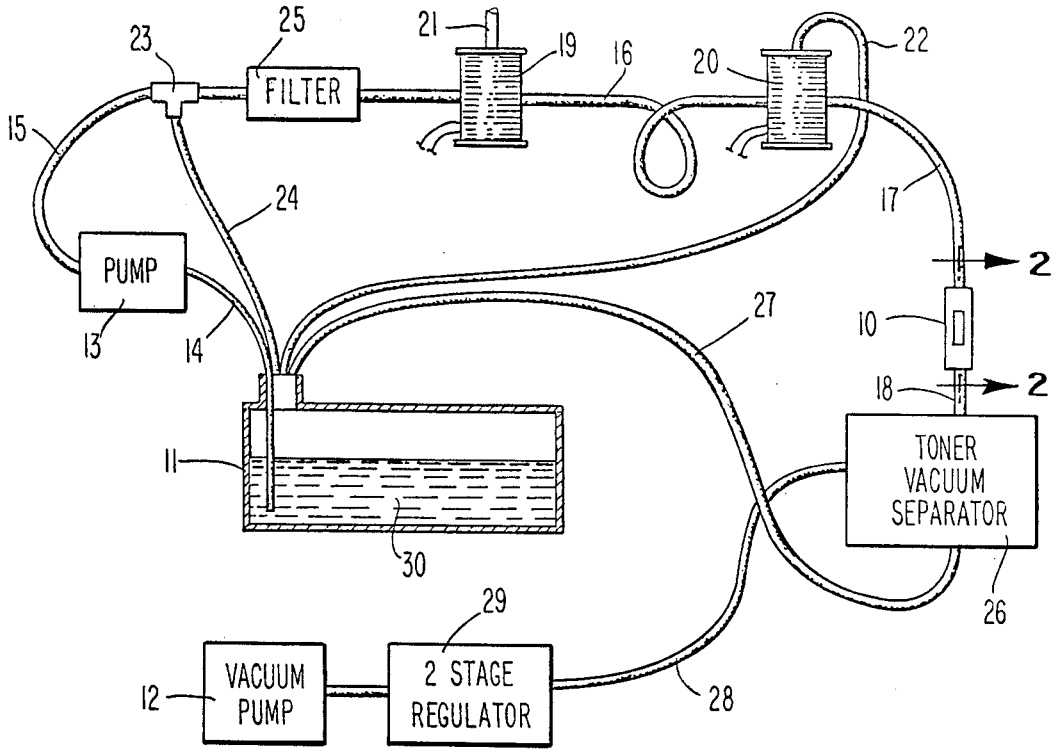
FIG. 1 is a diagrammatic view of the developing apparatus of the invention.

Referring to FIG. 1, the toner supply network in accordance with one embodiment of the present invention is in the form of a closed system and includes a suitable toner reservoir 11 containing a supply of liquid toner 30. Liquid toner 30 may be of any suitable type well known in the art, but preferably consisting of black colored electroscopic particles colloidally suspended in a liquid vehicle. A four-part connector block communicates interiorly of the reservoir 11 and supports a toner pickup tube 14 which is connected to a toner pump 13.

The pump 13 supplies toner via line 15 to a pressure relief or bypass valve 23 having first and second outlet ports communicating respectively with reservoir 11 via tube 24, and with the processing assembly via tube 16. Tube 16 feeds first solenoid valve 19 through a suitable filter element 25. Solenoid valve 19 is vented to the atmosphere through tube 21 and has its outlet port connected to the inlet of a second solenoid valve 20 by a short length of tube 16. Tube 16 between the first and second solenoid valves 19 and 20 has an internal volume corresponding to the amount of toner necessary to effectuate the development of a single frame on a microfiche.

Solenoid valve 20 communicates with the fluid reservoir 11 by conduit 22 and has its outlet port coupled by a fluid line 17 to the inlet port 31 (FIG. 2) of the developing chamber 10. Outlet port 32 of the toner module is connected via conduit 18 to a toner vacuum separator 26 which separates unused toner and conducts it back to the reservoir 11 by gravity. A vacuum line 28 is also connected to the toner vacuum separator 26 and applies a negative pressure to the system through a two-stage regulator 29. Regulator 29 may be of any suitable construction known to those skilled in the art and is electrically controlled to selectively provide low and high vacuum levels to the toner vacuum separator 26. A vacuum pump 12 operably communicates with the two-stage regulator to complete the system.

Figure 2:
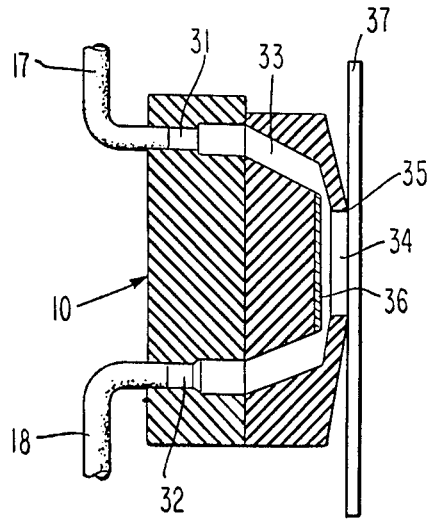
FIG. 2 is an enlarged cross-sectional view of the developing chamber illustrated in FIG. 1, taken along line 2—2.

FIG. 2 illustrates a microfiche 37 in position against the developing chamber 10 with the photoconductive surface of the microfiche facing the developing chamber 10. The developing chamber 10 includes an inlet 31, a passageway 33, and an outlet 32. Within the passageway 33 is an opening 34 formed by rectangularly shaped flange or mask means 35. The frame of the microfiche 37 to be toned (or developed) is placed against the opening 34 which is the same size as the frame, whereby toner particles flowing through the passageway 33 will contact that frame of the microfiche 37. Forming one wall of the chamber passageway 33 opposite the opening 34 is a development electrode 36, provided by a thin plate of electrically conductive material, such as copper. The development electrode 36 is beneficial in toning the image on the frame in a manner well known in the art. The development electrode 36 is preferably positioned close to the opening 34 to create a strong electric field between the electrode 36 and microfiche 37 and to force liquid toner flowing through the passageway 33 against the microfiche 37.

The developing chamber 10 is placed against the surface of the microfiche 37, and solenoid valve 19 of the toner supply circuit is opened, causing toner fluid to be pumped from reservoir 11 through solenoid valve 19 and tube 16 to the closed solenoid valve 20. Fluid thus circulates through tube 16 and solenoid valves 19 and 20 and is returned through tube 22 to the reservoir 30. In this manner, the portion of tube 16 between solenoid valves 19 and 20 is filled with toner fluid in the precise amount necessary for effectuating the development of the latent image on a single frame of the microfiche 37. Solenoid valve 19 is thereafter closed, opening vent tube 21, and solenoid valve 20 is simultaneously opened, closing off conduit 22, whereby the metered amount of toner fluid contained within tube 16 is conducted through tube 17 to the inlet port 31 of the developing chamber 10. Toner fluid is drawn through the developing chamber 10 by the vacuum at a low vacuum level setting by proper actuation of the two-stage regulator 29.

The two-stage regulator 29 is then switched to its high vacuum mode, thereby precluding the leakage of toner fluid from the developing chamber 10 around the microfiche 37 and pulling drying air through vent tube 21 to effect a substantial drying of the developed microimage.

In a preferred embodiment, the drying step also includes separating the microfiche 37 slightly from the mask means 35 to draw additional drying air into the developing chamber 10 from around the frame being developed for more effective drying. The use of vacuum creates an effective seal between the chamber 10 and the microfiche 37 for purposes of preventing toner fluid from leaking out.

Figure 3:
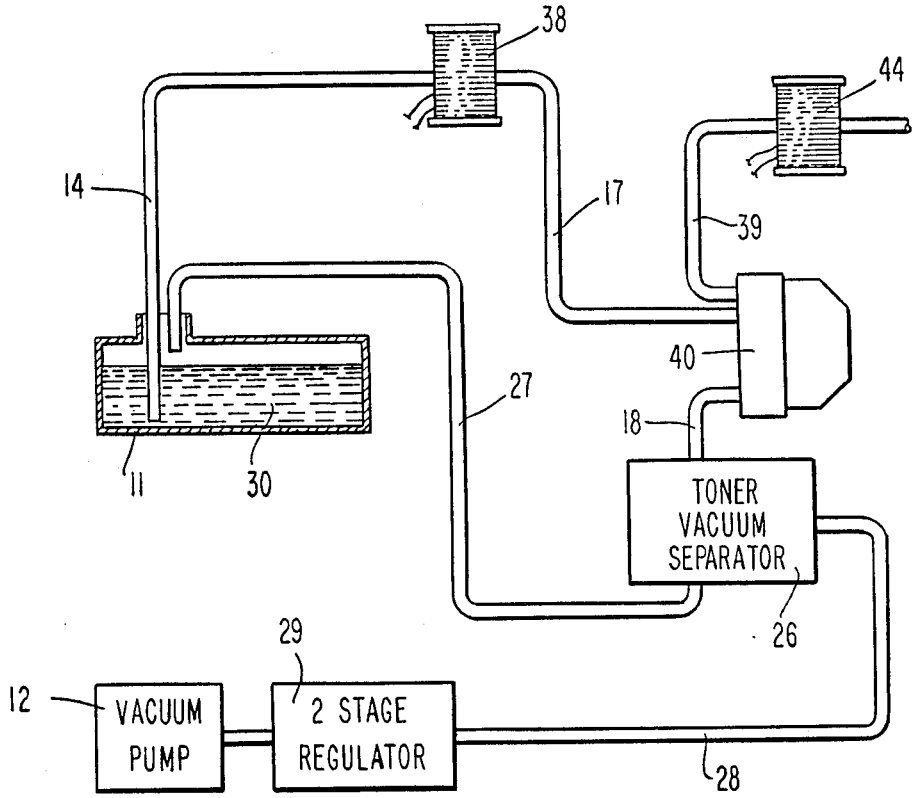
FIG. 3 is a diagrammatic view of the preferred embodiment of the developing apparatus of the invention.
Figure 4:
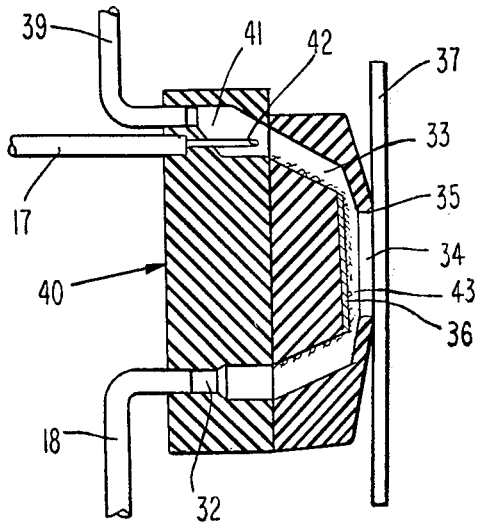
FIG. 4 is an enlarged cross-sectional view of the developing chamber illustrated in FIG. 3.

Referring to FIGS. 3 and 4, the preferred embodiment of the invention is disclosed (with the indicating numerals which are identical to indicating numerals in FIGS. 1 and 2 representing system components which are identical to the system components in FIGS. 1 and 2). The preferred system includes toner reservoir 11 containing liquid toner 30, and from which toner fluid is drawn through conduit 14, through solenoid valve 38 and line 17 into the inlet 41 of developing chamber 40 by way of orifice needle 42. The liquid toner 30 is drawn through chamber passageway 33, through the developing chamber outlet 32, and into the toner vacuum separator 26 by way of conduit 18. Toner vacuum separator 26 is a conventional liquid/gas separator and is connected by way of conduit 28 to vacuum pump 12 through two-stage regulator 29. Leading from the bottom of toner vacuum separator 26 is toner return line 27, which conducts the toner fluid back into the toner reservoir 11.

Drying air is conducted through solenoid valve 44 and conduit 39 into developing chamber inlet 41. Developing chamber 40 includes an opening 34 communicating with the chamber passageway 33 and formed by rectangularly shaped mask means 35. The frame of the microfiche 37 to be toned is placed against opening 34 to form a seal with mask means 35. Of course, the photoconductive layer of the microfiche 37 is faced inward into the developing chamber 40. One wall of the chamber passageway 33 is formed by development electrode 36 positioned opposite the opening 34 and very close to the opening to create a strong electric field between the electrode 36 and the microfiche 37 and to force the liquid toner flowing through the chamber passageway 33 against the microfiche 37. The development electrode can be provided by a very thin electrically conductive plate, and functions in a manner well known to those skilled in the art. Covering the development electrode 36 is a finely woven fabric 43, such as silk, which is saturated by the toner fluid during the toning process. The fabric 43 retains enough of the liquid carrier to remain moist during the drying step which will be described subsequently. In this way, permanent deposition of toner particles upon the development electrode 36 is prevented. The fabric 43 also can cover other portions of the passageway 33 walls to prevent permanent deposition of toner on them.

The operation of the preferred form of the invention will now be described. As soon as an imaged frame of a microfiche 37 is placed against opening 34 in the developing chamber 40, the vacuum pump 12 applies a low-level vacuum, controlled by a two-stage regulator 29, through conduit 28, toner vacuum separator 26, conduit 18, developing chamber 40, conduit 17, solenoid valve 38, and conduit 14 to draw toner particles 30 through the chamber passageway 33 of the developing chamber 40. During this operation the solenoid valve 38 is opened, and the solenoid valve 43 is closed to prevent air from being pulled through the conduit 39. The needle orifice 42 is sized to meter the liquid toner 30 through at a predetermined rate. A timer closes solenoid valve 38 when the desired quantity of toner fluid 30 has been pulled through the developing chamber 40. Immediately upon closing of solenoid valve 38, solenoid valve 43 opens, permitting drying air to be drawn through conduit 39 into the chamber passageway 33. At the same time the two-stage regulator 29 is switched to the high-vacuum level stage to draw air through at a fast rate. The air being drawn through at a fast rate assures quick evaporation of residual toner carrier liquid remaining on the microfiche 37, as well as drawing air in from any opening which might exist between the microfiche 37 and the mask means 35, thereby preventing toner fluid from flowing along the microfiche beyond the frame being toned or into the interior of the reproduction apparatus. Pulling the toner liquid 30 through the solenoid by vacuum means also creates a pressure within the passageway chamber 33 that is lower than the pressure of the outside air and draws air through any opening inadvertently formed between mask means 35 and the microfiche 37, thereby forming an air seal to prevent the liquid toner from leaking from the developing chamber 40.

What is claimed is:

1. Method of developing an electrostatic latent image on a portion of an electrophotographic film, comprising the steps of:

A. positioning the film against a mask bordering an opening in a developing chamber with the mask bordering the portion of the film being developed and forming a seal against fluid flow;

B. drawing toner liquid through the chamber and into contact with the portion of the film with a vacuum source which creates a sub-atmospheric pressure within the chamber to prevent leakage of the toner liquid from the mask beyond the portion of the film being developed; and C. after step B, drawing drying air through the chamber with a vacuum source which creates a sub-atmospheric pressure within the chamber to prevent toner liquid from leaking past the mask beyond the portion of the film during drying.

2. Method according to claim 1, wherein the toner liquid is drawn through the chamber at a low vacuum level in step B and the drying air is drawn through the chamber at a high vacuum level in step C.

3. Method according to claim 1, wherein step C further includes separating the film slightly from the developing chamber and drawing additional drying air into the chamber from around the film through the opening.

* * * * *